US005868020A

United States Patent [19]

Delaney et al.

[11] Patent Number: 5,868,020

[45] Date of Patent: Feb. 9, 1999

[54] BRAKE TIME MONITOR AND BRAKE CONTROL SYSTEM FOR A PRESS HAVING A PROGRAMMABLE CONTROLLER

[75] Inventors: Kevin O. Delaney, North Olmstead; Brian P. Delaney, North Ridgeville; John D. Diurba, University Heights, all of Ohio

[73] Assignee: Allen-Bradly Company, LLC, Milwaukee, Wis.

[21] Appl. No.: 841,231

[22] Filed: Apr. 29, 1997

[51] Int. Cl.[6] ..... B21B 37/00

[52] U.S. Cl. ..... 72/21.3; 72/441; 72/373; 364/476.01

[58] Field of Search ..... 72/20.1, 21.1, 72/21.3, 441, 446, 373; 364/476.01; 172/144, 146

[56] References Cited

U.S. PATENT DOCUMENTS

| | | | |
|---|---|---|---|
| Re. 34,559 | 3/1994 | Mickowski | 364/550 |
| 4,205,603 | 6/1980 | Baker, Jr. | 72/21.3 |
| 4,638,452 | 1/1987 | Schultz et al. . | |
| 5,113,684 | 5/1992 | Oster | 72/446 |
| 5,269,163 | 12/1993 | Yagi et al. | 72/20.1 |
| 5,433,097 | 7/1995 | Nord | 72/20.1 |
| 5,471,608 | 11/1995 | Lee et al. | 395/550 |
| 5,522,244 | 6/1996 | Eigenmann et al. | 72/21.3 |
| 5,535,380 | 7/1996 | Bergkuist, Jr. et al. | 395/550 |
| 5,636,124 | 6/1997 | Rischar et al. | 364/468.06 |

OTHER PUBLICATIONS

1997 Rockwell International Corp. Product Information, "Low Cost Clutch/Brake Control System and Configuration Software Available From Allen–Bradley", Apr. 12, 1994.

*Primary Examiner*—Joseph J. Hail, III
*Assistant Examiner*—Ed Tolan
*Attorney, Agent, or Firm*—David G. Luettgen; John M. Miller; John J. Horn

[57] ABSTRACT

A brake time measurement and brake control system measures the brake time of a subassembly, such as an upper die of a press, with the programmable controller already used to control the press. The programmable controller has a selectable time interrupt which causes an interrupt routine inside the programmable controller to be executed at regular time intervals. By varying the duration of the interval, the precision of the brake time measurement may be varied. Also, since the system is implemented with the programmable controller already present on the press, no additional equipment is needed to measure brake time. The brake time monitor and brake control system also implements a top stop control capability with improved precision. The improved precision results from dynamically determining a top stop zone which is appropriately sized given the speed of the die. The improved precision also results from limiting the number of angles at which a stop command can be issued when the top stop zone is larger than necessary.

17 Claims, 7 Drawing Sheets

BRAKE TIME MONITOR AND BRAKE CONTROL SYSTEM FOR A PRESS HAVING A PROGRAMMABLE CONTROLLER

FIELD OF THE INVENTION

The present invention relates to systems for measuring the brake time of a press, and to systems for controlling the braking of a press. Specifically, the present invention relates to brake time measurement systems and/or brake control systems for a press which utilize a selectable time interrupt of a programmable controller.

BACKGROUND OF THE INVENTION

Stamping presses are power-driven machines useful for stamping or otherwise shaping metal and other material by heavy blows. A stamping press comprises upper and lower dies disposed respectively between a slide and a bed. The slide, and therefore the upper die, is driven up and down by a motor. The motor is connected to the slide by way of a flywheel and a crankshaft. The motor continuously drives the flywheel and, when a clutch/brake mechanism is engaged, the flywheel turns the crankshaft which moves the slide up and down. When the clutch is disengaged, the brake engages to stop movement of the upper die. In use, sheet metal is placed between the upper and lower dies and the upper die descends rapidly to stamp the sheet metal.

During operation of the stamping press, it is important that the stopping of the upper die be precisely (or repeatably) measured and controlled. Two separate problems have been identified in this regard.

The first problem has been to provide a convenient way to precisely measure the brake time of the stamping press. The brake time is the amount of time that it takes the upper die to stop moving once a stop command has been issued to the brake. Safety standards (specifically, OSHA 1910.217) require that the brake time of a stamping press with an air activated clutch/brake be periodically measured in order to detect brake wear before it becomes dangerous to operate the stamping press.

Two approaches are currently used for measuring brake time. The first (more common) approach involves attaching a retractable string to the upper die using a magnet. The retractable string is on a spring loaded spool located inside a black box, and retracts back into the black box as the upper die travels downwardly. The black box is also connected to the stamping press control system. The black box calculates the brake time based on the amount of time that the flywheel continues to rotate (as indicated by the movement of the string) after a stop command is issued (as indicated by an input from the control system).

The second approach involves connecting a black box to the control system and to a resolver or an encoder which is attached to the flywheel. In this case, the black box calculates the brake time based on the amount of time that the slide, or die, continues to move (as indicated by the encoder/resolver) after a stop command is issued (as indicated by the input from the control system).

Both of these approaches suffer from several disadvantages. First, these approaches require extra equipment (the black boxes) which do nothing other than measure the brake time of the stamping press. The use of extraneous equipment in this manner is undesirable. Further, these approaches are primarily adapted for making only occasional measurements of brake time. These approaches are not intended to be used for measuring brake time every time the stamping press stops, which would enhance the ability to perform predictive maintenance. Moreover, the precision of these approaches is fixed; the black box devices currently in use do not provide the user with a way of adjusting the precision of the brake time measurement. Finally, the string approach is especially disadvantageous because the string bounces when the upper die stops, thereby making it appear as though the upper die is still moving when in fact it has stopped.

A second problem has been to provide a repeatable way of positioning the upper die of a stamping press, and especially a way of positioning the upper die at the top position in a high speed press. The top position refers to the uppermost position of the die, also referred to as the 0° position. (The upper dies starts movement at 0°, then travels downwardly past the downward half-way position at 90° and to the bottom position at 180°, and then travels upwardly past the upward half-way position at 270° and returns to the top position at 0°.)

When performing a top stop, the clutch is disengaged and the brake is engaged causing the upper die to come to an eventual stop. Of course, however, the upper die does not come to an immediate stop. Thus, in order to cause the upper die to come to a stop at the top position, the stop command must be given in advance of the time at which the upper die is at the top position. More specifically, the stop command must be timed such that, once braking occurs, the upper die comes to a stop at the top position.

Typical (non-high speed) presses issue the stop command in the range 200°–355°, depending on the speed of the press. Thus, when the upper die reaches a predetermined top stop angle (e.g., 340°, assuming it takes the upper die 20° to stop), a stop command is issued, and the upper die comes to a stop at approximately the top position.

To determine whether the upper die has reached the top stop angle, a takeover cam mechanism is utilized. The takeover cam is a limit switch which turns on when the upper die reaches 180° and turns off when the upper die reaches the top stop angle. Thus, the top stop sequence for a typical press may be as follows: First, the upper die reaches 180° and the takeover cam turns on. Then, the operator removes his hand from the actuation button and a top stop input is generated. However, since the takeover cam is on, the control system recognizes that the upper die has already reached 180° and thus continues to permit the upper die to move upward (since there is no threat posed to the operator once the upper die reaches 180°). When the upper die reaches the top stop angle, the takeover cam turns off. The control system detects that the takeover cam has turned off, and that a top stop input has been generated, and in response the control system issues a stop command.

In a high speed press, it is necessary to issue the stop command much earlier (i.e., in the 0°–180° range) because it takes the upper die a longer period of time to stop. Thus, since the stop command must be issued before the upper die reaches 180°, the above-described sequence of events is not possible and it is not possible to use the above-described takeover cam mechanism in conjunction with a high speed press. Accordingly, an alternative top stop system for high speed presses is needed.

Efforts to provide an acceptable alternative top stop system for use with a high speed press have met with considerable difficulty. Specifically, it has been difficult to provide a way to issue the stop command when the upper die is approximately at the top stop angle. The difficulty arises because the instantaneous angle of the upper die is usually not known. The angle of the upper die is not monitored continuously but rather only at periodic intervals, and thus the control system is unlikely to know the precise instant at which the upper die is at the top stop angle for a given stroke. (It may be noted that, depending on the length of the intervals, the angle of the upper die may change as much as 30°, and perhaps more, between intervals.) This introduces a significant and undesirable amount of variability as to the stopping point of the upper die in a high speed press. Thus, whereas control systems for typical presses are able to stop the upper die at the top position with a ±2° variance, conventional control systems for high speed presses are only able to stop the upper die with ±15° variance.

Thus, what is needed is a way to measure the brake time of a stamping press which does not require any additional equipment, which can be conveniently performed each time the upper die of the stamping press stops, which can have varying degrees of precision, and/or which does not suffer from the inaccuracies associated with string bounce. What is also needed is a precise way of positioning the upper die of a stamping press, and especially a way of positioning the upper die at the top position in a high speed press.

BRIEF SUMMARY OF THE INVENTION

A brake time measurement and control system measures the brake time of a subassembly, such as a die of a press, with the programmable controller already used to control the press. Thus, the same programmable controller that sends a stop command to stop the movement of the die also measures the brake time of the die after the stop command is issued.

The brake time of the subassembly is measured by an interrupt routine inside the programmable controller which is executed at regular time intervals. The interrupt routine may be executed at regular time intervals of a first duration while performing a first brake time measurement, and then executed at regular time intervals of a different duration while performing a second brake time measurement. Thus, the duration of the regular time intervals is variable such that the precision of the brake time measurement is variable.

A method of measuring brake time of a die of a press according to the present invention includes the steps of issuing a stop command and then measuring the brake time of the die. The step of measuring the brake time of the die includes the steps of initiating a brake time counter, determining whether the die is still moving, incrementing the brake time counter, and repeating the determining and incrementing steps at least until the die stops moving. Both the stop command issuing step and the measuring step are performed by the programmable controller; thus, no extra equipment is needed to measure brake time.

Preferably, the method also includes the step of filtering mechanical vibrations of the press. The filtering step may be performed by implementing a filter counter which increments only when the angle change of the die is positive, and otherwise resets. The brake time measurement is then made by subtracting the value of the filter counter from the value of the brake time counter.

Advantageously, the present invention provides a system capable of measuring brake time which does not require additional dedicated equipment. Further, the system may be used for measuring the brake time every time the press stops, rather than only for periodic brake time measurements. Additionally, the precision of the system may be varied to obtain brake time measurements of different precision, as needed.

A method of stopping a die of a press according to the present invention includes the steps of determining a current angle of the die, dynamically determining a stop zone, determining whether the current angle is within the stop zone, and sending a stop command to stop the die when the current angle is within the stop zone.

The stop zone is preferably a top stop zone which includes a top stop angle that is separated from the top position by a braking angle. The braking angle is the angle change of the upper die as the upper die brakes to a stop. Further, the dynamically determining step preferably includes the steps of comparing the current angle to a previous angle to determine a current angle change, and determining the top stop zone as a function of the current angle change.

The step of determining whether the current angle is within the stop zone preferably includes the steps of determining for a first time whether the current angle is within the stop zone and, if the current angle is within the stop zone, then repeating the first time determining step until the current angle is not within the stop zone; and then determining for a second time whether the current angle is within the stop zone and, if the current angle is not within the stop zone, then repeating the second time determining step until the current angle is within the stop zone. The step of sending a stop command to stop the die when the current angle is within the stop zone is then performed after the second determining step is complete. The method is especially useful for stopping an upper die at a top position of a high speed press.

Advantageously, the method of stopping the die has improved precision characteristics as compared to conventional methods. The improved precision results from dynamically determining a stop zone which is appropriately sized given the speed of the die. The improved precision also results from limiting the number of angles at which a stop command can be issued when the stop zone is larger than necessary.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 1B:
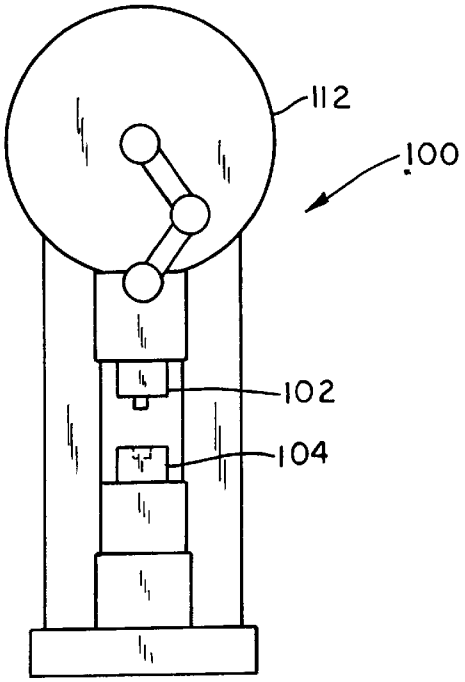
FIGS. 1A–1B illustrate schematic front and side views, respectively, of a stamping press which utilizes a brake time measuring system and a brake control system, in accordance with the present invention.
Figure 1A:
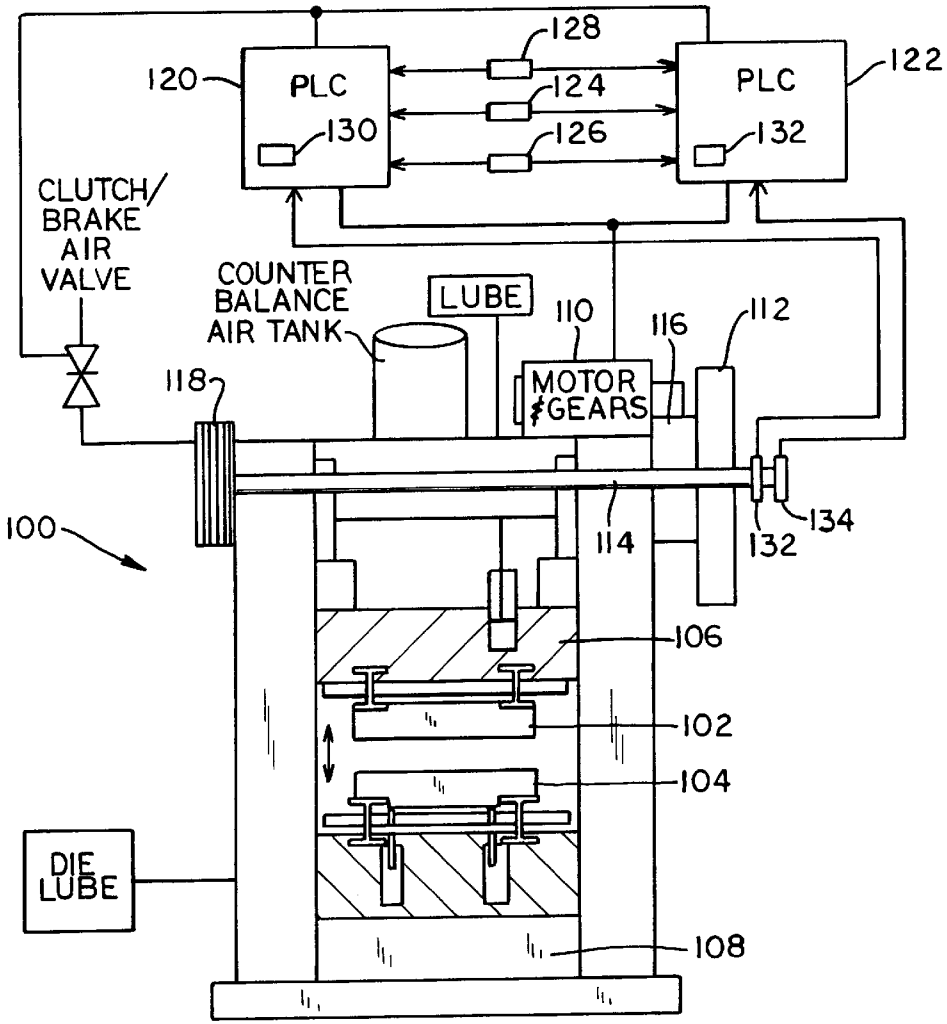

FIGS. 1A–1B illustrate schematic front and side views of a press, and more specifically a stamping press 100, which utilizes a brake time measuring system and a brake control system in accordance with the present invention. As described above, the stamping press 100 comprises an upper die 102 and a lower die 104 disposed respectively between a slide 106 and a bed 108. The slide 106 and the upper die 102 are driven up and down by a motor 110. The motor 110 is connected to the slide 106 by way of a flywheel 112 and a crankshaft 114. The motor continuously drives the flywheel 112 and, when a clutch 116 is engaged, the flywheel 112 turns the crankshaft 114 which moves the slide 106 up and down. When the clutch 116 is disengaged, the brake 118 engages to stop movement of the upper die 102.

The stamping press 100 is controlled by redundant programmable controllers 120 and 122. In a cooperative manner, both of the programmable controllers 120 and 122 control the starting and stopping of the movement of the die 102 during normal operation of the stamping press 100. A preferred programmable controller for use with the present invention is the "SLC™ 5/03" programmable controller, which is one of the programmable controllers sold under the trademark "PLC®" by Allen-Bradley Company, Inc. of Milwaukee, Wis.

Each of the programmable controllers 120 and 122 is connected to a pair of actuation buttons 124 and 126 and to a hardwired top stop input 128. The programmable controllers 120 and 122 are also connected to resolvers 132 and 134, respectively.

In single stroke mode, the operator places sheet metal in the stamping press and places both hands on the actuation buttons 124 and 126 (one hand per button). This causes the clutch 116 to engage and the upper die 102 to rapidly descend on the sheet metal, thereby stamping the sheet metal. The operator is required to put one hand on each button so as to ensure that neither hand is in between the upper and lower dies 102 and 104 when the upper die 102 descends on the lower die 104. Further, OSHA 1910.217 ensures (assuming compliance) that the brake time is short enough such that the upper die 102 stops before the operator can move a hand from one of the buttons 124 and 126 to a pinch point between the upper and lower dies 102 and 104. The maximum allowable brake time is thus a function of the distance between the actuation buttons 124 and 126 and the nearest pinch point on the stamping press 100.

In continuous mode in a high speed press, the press 100 operates without an operator. When operation is to be terminated, an operator may push a button which implements the top stop input 128. Alternatively, a top stop input 130 or 132 may be issued in software by one of the programmable controllers 120 and 122, respectively. In either case, the purpose of the top stop input is to cause the upper die 102 to stop at the 0° position as previously described.

Figure 2A:
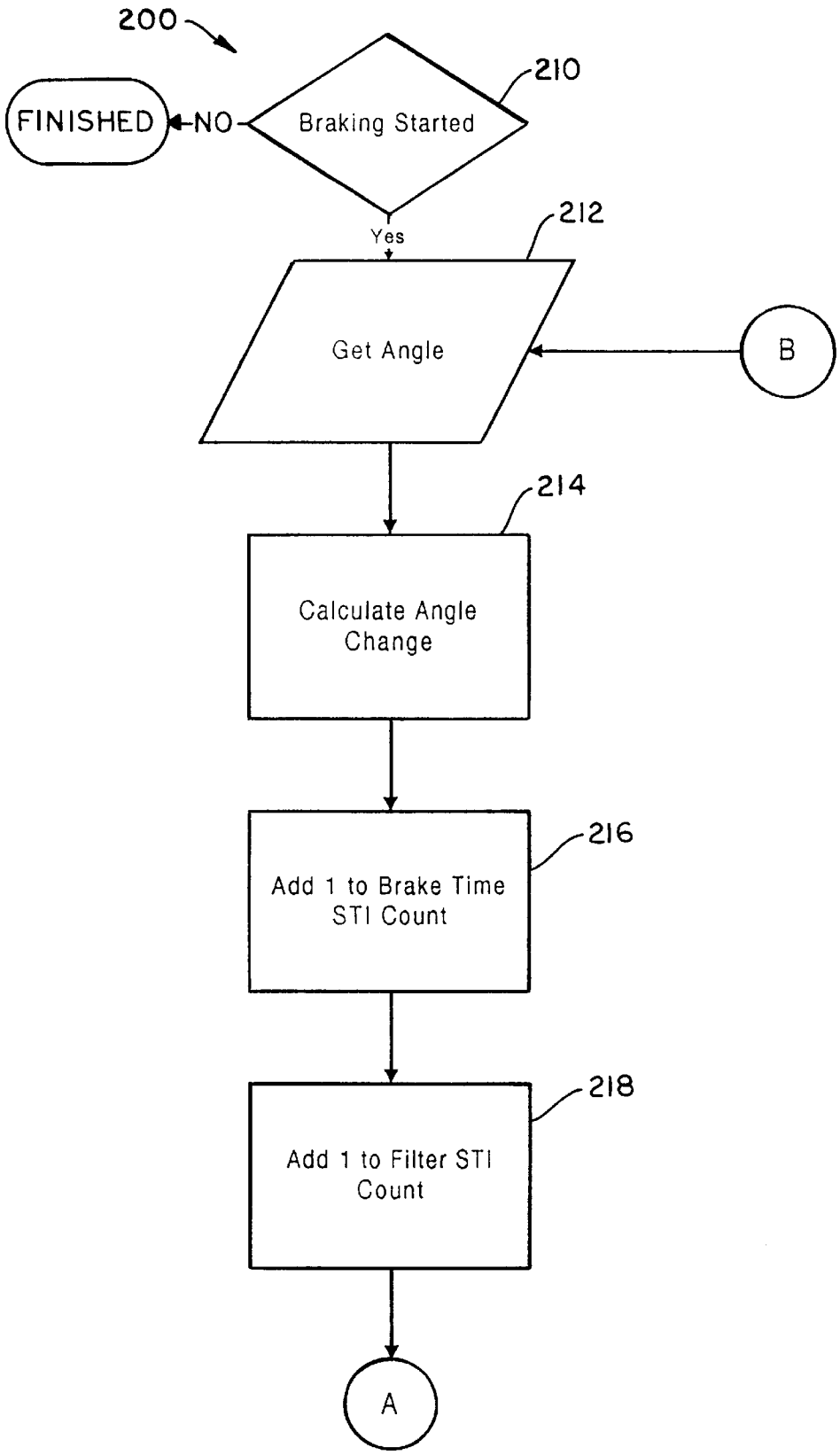
FIGS. 2A–2C are flow charts illustrating a process which is used for measuring the brake time of a stamping press and which is implemented by a programmable controller, in accordance with the present invention.
Figure 2B:
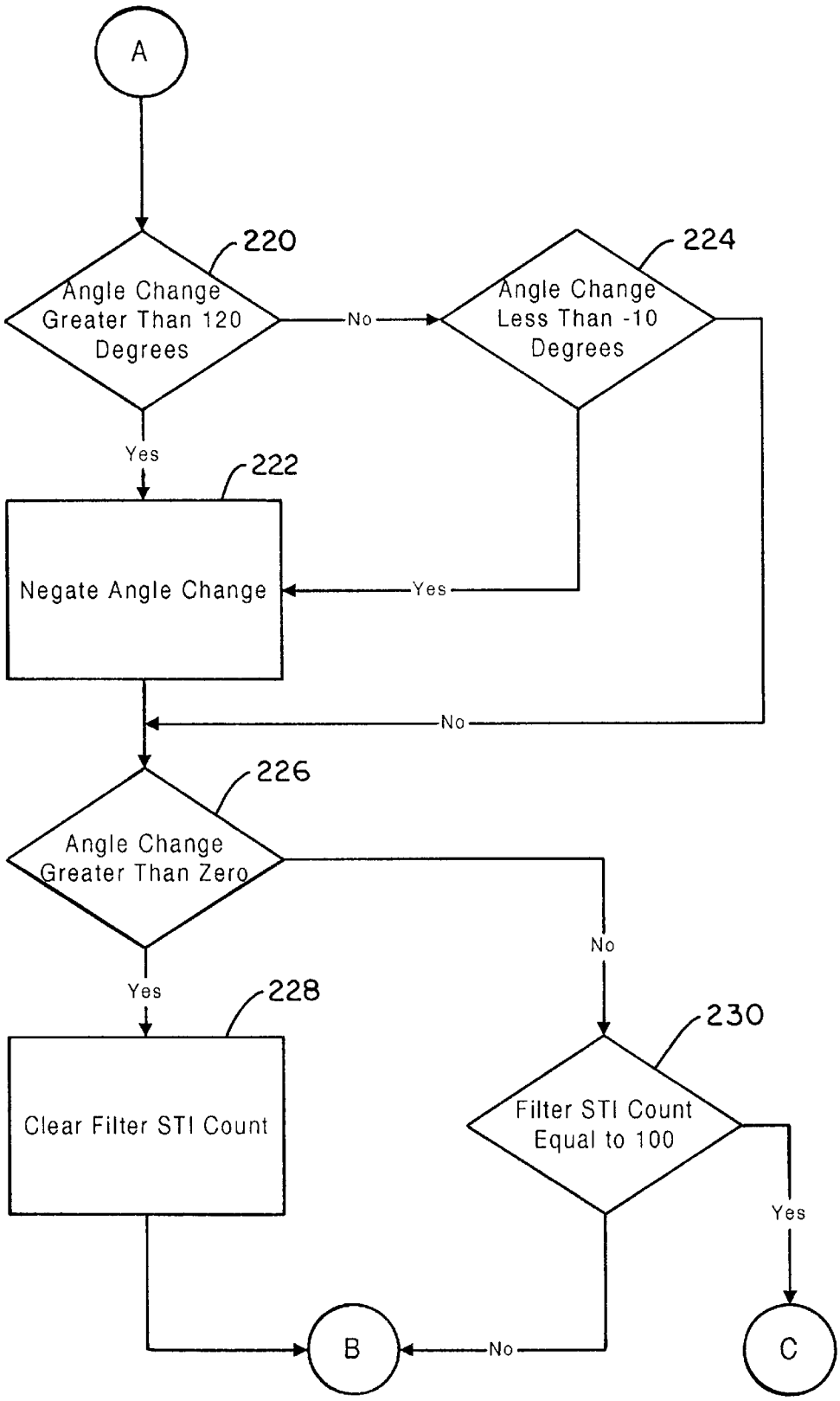
Figure 2C:
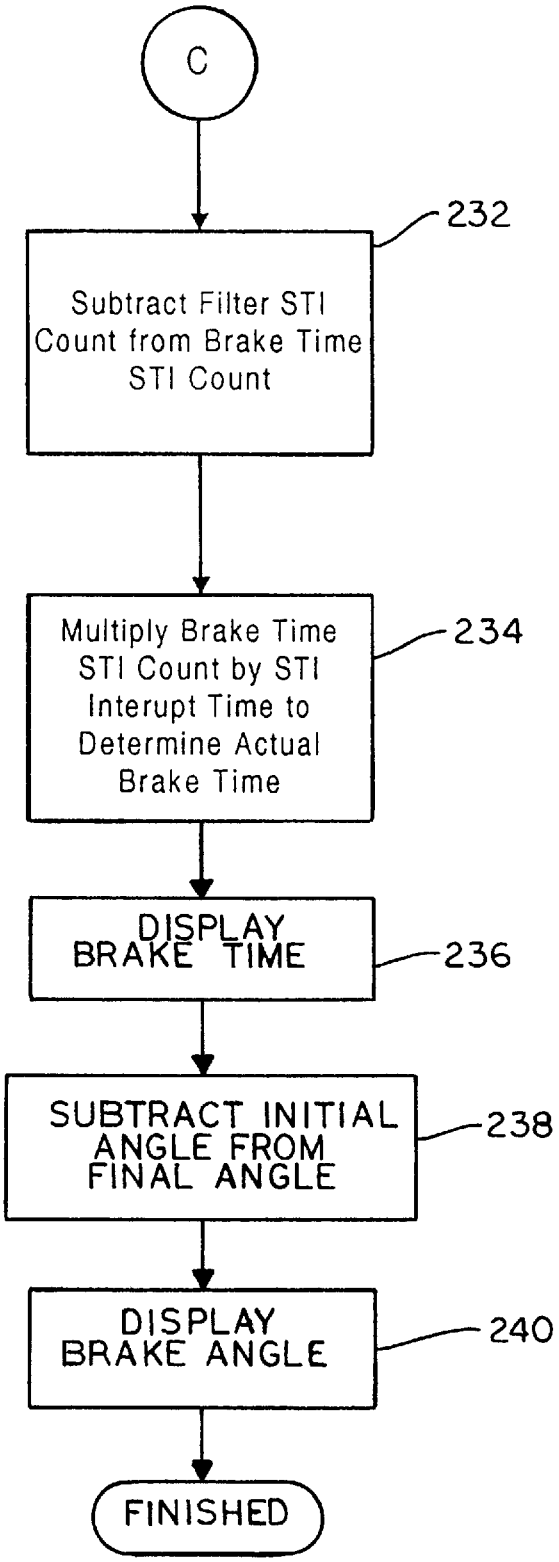

FIGS. 2A–2C illustrates a process 200 used to measure brake time according to the present invention. The process 200 is implemented by each of the redundant programmable controllers 120 and 122. For convenience, the process 200 is described with respect to the programmable controller 120, it being understood that the programmable controller 122 implements the same process redundantly.

The process 200 is implemented using a selectable time interrupt (STI) of the programmable controller 120. The selectable time interrupt enables a program file of the programmable controller 120 to be executed at regular time intervals which are preferably of equal duration. Thus, if the duration of the STI interval for the process 200 is set to 5 msec, then one iteration of the process 200 is executed every 5 msec. Further, if the brake time is 300 msec, then approximately sixty iterations of the process 200 occur as the upper die 102 comes to a stop (60 iterations×5 msec=300 msec). A selectable time interrupt which is implemented in a programmable controller is disclosed, for example, in U.S. Pat. No. 4,638,452, entitled "Programmable Controller with Dynamically Altered Programmable Real Time Interrupt Interval", which is hereby expressly incorporated by reference.

Advantageously, the duration of the STI interval may be varied in order to vary the precision of the brake time measurement. Thus, in the preceding example, the brake time measurement has a precision of 5 msec. However, a more precise brake time measurement could be attained by setting the STI interval to occur more frequently (e.g., every 2 msec, yielding a precision of ±2 msec), and a less precise brake time measurement could be attained by setting the STI interval to occur less frequently (e.g., every 10 msec, yielding a precision of ±10 msec). Moreover, because the STI interval can be set to occur very frequently, very high degrees of precision can be obtained.

The process 200 starts at decision step 210 where it is determined whether braking has been initiated. Whether braking has been initiated is relatively easy for the programmable controller 120 to determine, since the stop command is issued by the programmable controller 120 itself. If braking has not been initiated, then the process 200 ends immediately. (Note that iterations of the process 200 preferably occur, even if only in a very abbreviated sense, at regular intervals regardless whether or not braking has been initiated.)

Assuming braking has been initiated, then the process 200 proceeds to step 212 where the resolver 132 is read to determine the angle $\alpha$ of the crankshaft 114. At step 214, the angle change $\Delta\alpha$ since the last iteration of the process 200 occurred is calculated. For example, if $\alpha$=240° for the previous iteration of the process 200, and $\alpha$=243° for the current iteration, then $\Delta\alpha$=3°.

The process 200 then proceeds to steps 216 and 218, where a brake time STI count and a filter STI count, respectively, are incremented by one count unit. In each case, the one count unit corresponds to one STI interval, such that adding one count unit to the brake time STI count is the equivalent of adding 5 msec to a timer count (assuming the STI interval is 5 msec). The brake time STI count and the filter STI count are each implemented in a register of the programmable controller 120. The use of the brake time STI count and the filter STI count will become more apparent from the discussion of steps 226–234 below.

The process 200 then proceeds to steps 220–226. The purpose of steps 220–226 is to provide an indication of whether the upper die 102 is still moving. Generally, a positive angle change indicates that the upper die 102 is still moving, and a non-positive angle change indicates that the upper die 102 has stopped moving. Thus, in most cases, whether the upper die 102 is still moving can be determined simply by testing whether the angle change $\Delta\alpha$ as calculated in step 214 is positive.

However, whether the angle change $\Delta\alpha$ as calculated in step 214 is positive does not always provide an accurate indication of whether the upper die 102 is still moving. For example, the resolver 132 may produce an invalid output, for example an output which causes the angle change $\Delta\alpha$ to be assigned a value of 200°, which is too large and therefore invalid. Alternatively, the output of the resolver 132 could pass through 0° (e.g., a transition from 357° to 1°). In this case, the angle change $\Delta\alpha$=−356° (non-positive), even though the upper die 102 is still moving. The purpose of steps 220–226 is to handle these more complicated situations.

At step 220, it is determined whether the angle change $\Delta\alpha$ is greater than a first predetermined test value, e.g., 120°. This test is designed to detect angle change values which are too large and therefore invalid. In the event that the angle change $\Delta\alpha$ is larger than the predetermined test value, then the angle change $\Delta\alpha$ is negated in step 222. As a result, the angle change $\Delta\alpha$ is given a negative value, the practical effect being that the step 226 is not passed as detailed below.

The specific first predetermined test value used may be determined depending on the speed of the stamping press 100. Thus, for example, while the 120° test value could be used for a stamping press which operates at about 1000 strokes per minute, a lower value could be used for a stamping press which operates at a slower speed.

If the angle change $\Delta\alpha$ is less than the first predetermined value, it is assumed that the angle change $\Delta\alpha$ value is not invalid for being too large. The process 200 then proceeds to step 224, where it is determined whether the angle change $\Delta\alpha$ is less than a second predetermined test value, e.g., −10°. This test is designed to detect when the resolver output incurred a zero crossing (e.g., a transition from 357° to 1°, yielding $\Delta\alpha$=−356°). In the event that the angle change $\Delta\alpha$ is less than the second predetermined test value (e.g., $\Delta\alpha$=−356°), then the angle change $\Delta\alpha$ is negated in step 222. As a result, the angle change $\Delta\alpha$ is given a positive value when it otherwise would have been negative, the practical effect being that the step 226 is passed as detailed below.

If the angle change $\Delta\alpha$ is greater than the second predetermined test value (and less than the first predetermined test value—a foregone conclusion in step 224), then that corresponds to either mechanical vibrations as the upper die 102 stops (slightly negative angle change $\Delta\alpha$) or to normal forward movement of the upper die 102 (small positive angle change $\Delta\alpha$). In this case, the angle change $\Delta\alpha$ is not negated at step 222.

The specific second predetermined test value used may be determined depending on how much mechanical vibration is expected. For example, if more severe mechanical vibrations are expected, a value which is less than −10° (e.g., −15°) could be used; if less severe mechanical vibrations are expected, a value which is more than −10° (e.g., −5°) could be used.

It may be noted that the output range of the resolver 132 is 0° to +359°. Therefore, the range of the angle change $\Delta\alpha$ as calculated in step 214 is −359° to +359°. The results and physical significance of each of the possible angle change values is summarized in Table 1 below.

TABLE 1

Summary of possible angle change values.

| Angle change | Result | Physical Significance |
|---|---|---|
| $-359° \leqq \Delta\alpha \leqq -11°$ | Step 120: "No"<br>Step 124: "Yes"<br>$\Delta\alpha \rightarrow -\Delta\alpha$ | Resolver output went through a zero crossing |
| $-10° \leqq \Delta\alpha \leqq +120°$ | Step 120: "No"<br>Step 124: "No"<br>$\Delta\alpha \rightarrow$ same | Mechanical vibrations ($\Delta\alpha < 0$), or upper die is still moving ($\Delta\alpha > 0$) |
| $+121° \leqq \Delta\alpha \leqq +359°$ | Step 120: "Yes"<br>Step 124: N/A<br>$\Delta\alpha \rightarrow -\Delta\alpha$ | Invalid resolver output |

After the completion of the combination of steps 220–226, the process 200 then proceeds to steps 228–232. The purpose of steps 228–232 is to filter out the mechanical vibrations which occur as the upper die 102 comes to a stop. The operation of the filter is explained by reference to the illustrative braking scenario set forth in Table 2 below.

TABLE 2

Illustrative braking scenario.

| Brake Time STI Count | Angle Change $\Delta\alpha$ | Filter STI Count |
|---|---|---|
| 1 | 6 | 0 |
| 2 | 6 | 0 |
| *** | *** | *** |
| 39 | 2 | 0 |
| 40 | 2 | 0 |
| 41 | 1 | 0 |
| 42 | 1 | 0 |
| 43 | 0 | 1 |
| 44 | −1 | 2 |
| 45 | 1 | 0 |
| 46 | 0 | 1 |
| 47 | −1 | 2 |
| 48 | 0 | 3 |
| *** | *** | *** |
| 144 | 0 | 99 |
| 145 | 0 | 100 |

With reference to the first column, it is seen that the brake time STI count is initiated at one and steadily increases thereafter. (Note that, for sake of brevity, brake time STI counts 3–38 and 49–143 have been skipped in Table 2, as represented by the "*" entries.) This is expected, since the brake time STI count is incremented (at step 216) one count unit each iteration of the process 200**, and is never decremented or cleared (i.e. except when the brake time measurement is complete).

With reference to the second column, it is seen that the angle change $\Delta\alpha$ at first steadily decreases (brake time STI counts 1–42), then oscillates around zero when mechanical vibrations occur as the upper die 102 comes to a stop (brake time STI counts 43–45), and then does not exceed zero after the upper die 102 comes to a complete stop (after brake time STI count 45).

The upper die 102 is considered "stopped" once there are no more positive angle changes. Thus, in the example illustrated in Table 2, the upper die 102 was moving as of STI brake count 45 and then was stopped as of STI brake count 46. However, as can be seen in Table 2, the angle change $\Delta\alpha$ is also equal to zero at brake time STI count 43 due to mechanical vibrations, even though the upper die 102 later moves forward as indicated by the angle change $\Delta\alpha=1$ at brake time STI count 43. Thus, the filter implemented by the filter STI count enables the last positive angle change to be used as a basis for the brake time measurement.

The filter operates in the following manner. As previously mentioned, the filter STI count is incremented one unit at step 218 during each iteration of the process 200. However, if at decision step 226 it is determined that the angle change $\Delta\alpha$ is positive, then the filter STI count is cleared at step 228 and the next iteration of the process 200 returns to step 212. On the other hand, if the angle change $\Delta\alpha$ is non-positive, then the filter STI count is permitted to increment.

Thus, with reference to the third column of Table 2, it is seen that the filter count remains at zero while the angle change $\Delta\alpha$ is positive (brake time STI counts 1–42), then briefly begins to increment when the angle change $\Delta\alpha$ oscillates (brake time STI counts 43–44), then returns to zero when the angle change $\Delta\alpha$ returns positive (brake time STI count 45), and finally increments steadily after the angle change $\Delta\alpha$ is no longer positive and the upper die 102 is stopped (after brake time STI count 45).

For each incrementation of the filter STI count, it is determined at step 230 whether the filter STI count is equal to 100. When the filter STI count is equal to 100 (i.e., at brake time STI count 145 in the above example), then that indicates that the upper die 102 has not moved forward for one hundred STI counts, and it is assumed that the stamping press 100 has stopped completely.

Accordingly, a brake time value indicative of the measured brake time is calculated in steps 232–234. In step 232, the filter STI count is subtracted from the brake time STI count. (In the above example, 100 is subtracted from 145, yielding 45.) In step 234, the resulting number is multiplied by the STI interval duration to determine the actual brake time. (If the STI interval duration in the above example is 5 msec, then 45×5 msec=225 msec brake time.) The brake time value is then displayed in step 236.

Preferably, the braking angle change of the upper die 102 is also displayed. The braking angle change is the angle change of the upper die 102 which occurs during braking. Although OSHA only requires that brake time be measured, it is nevertheless often desirable to also measure the braking angle change. Numerous methods could be used to calculate the braking angle change. For example, an initial angle and a final angle could be determined, and then the difference taken to yield the braking angle change. The braking angle change is calculated and displayed in steps 238–240, thereby completing the process 200.

The process 200 has several advantages over prior methods of measuring brake time. First, no additional equipment is required to measure brake time according to the present invention. The programmable controllers 120 and 122 as well as the resolvers 132 and 134 already implement control functions in the stamping press. The present invention simply adds an additional function to existing hardware rather than requiring new hardware.

Second, the brake time can be measured every time the press stops. According to prior art methods, brake time can not be measured every time the press stops unless the operator is willing to leave the additional brake time measuring equipment continuously in place. According to the present invention, it is possible and convenient to measure brake time every time the press stops, and allows predictive maintenance to be performed. Thus, the maintenance can be performed on the press before the press becomes unsafe to operate and before production capabilities are lost due to unexpected down time.

Third, the use of the selectable time interrupt permits the precision of the brake time measurement to be varied. By varying the duration of the STI interval, the precision of the measurement can be increased or decreased as necessary. Thus, if one interrupt occurs every 2 msec, the stopping time measurement is precise to within ±2 msec (OSHA requires precision to within 10 msec). Moreover, the use of the selectable time interrupt permits a high degree of precision to be attained.

It should be noted that, while the brake time measuring system is described in the context of OSHA requirements, it may be used in conjunction with other applications having nothing to do with OSHA compliance. Indeed, the brake time measuring system could be used in virtually any situation where it is desirable to measure the brake time of a subassembly of a device having a programmable controller.

It should also be noted that other definitions could be used to define when the upper die is "stopped." For example, the upper die could be considered stopped when no more movement of the upper die occurs (positive or negative). This would simplify steps 220–226, because essentially all that would be required would be to test at step 226 whether the angle change $\Delta\alpha$ is non-zero. However, this approach has the drawback that it does not filter the noise associated with the mechanical vibrations as the upper die comes to a stop. In a similar vein, other methods could be used to determine when braking has been initiated.

Figure 3A:
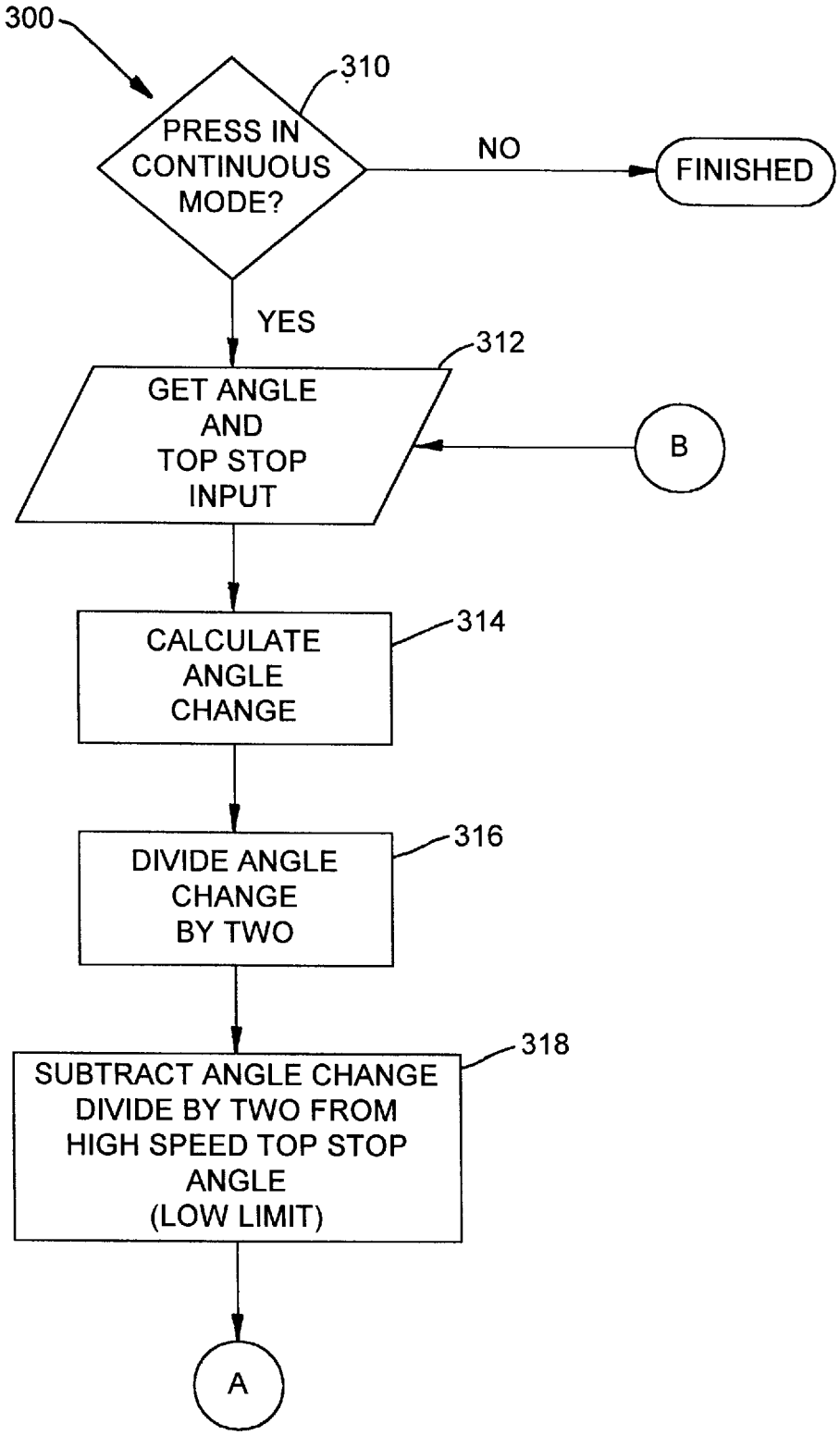
FIGS. 3A–3C are flow charts illustrating a process which is used for controlling the stopping position of the upper die of a stamping press and which is implemented by a programmable controller, in accordance with the present invention.
Figure 3B:
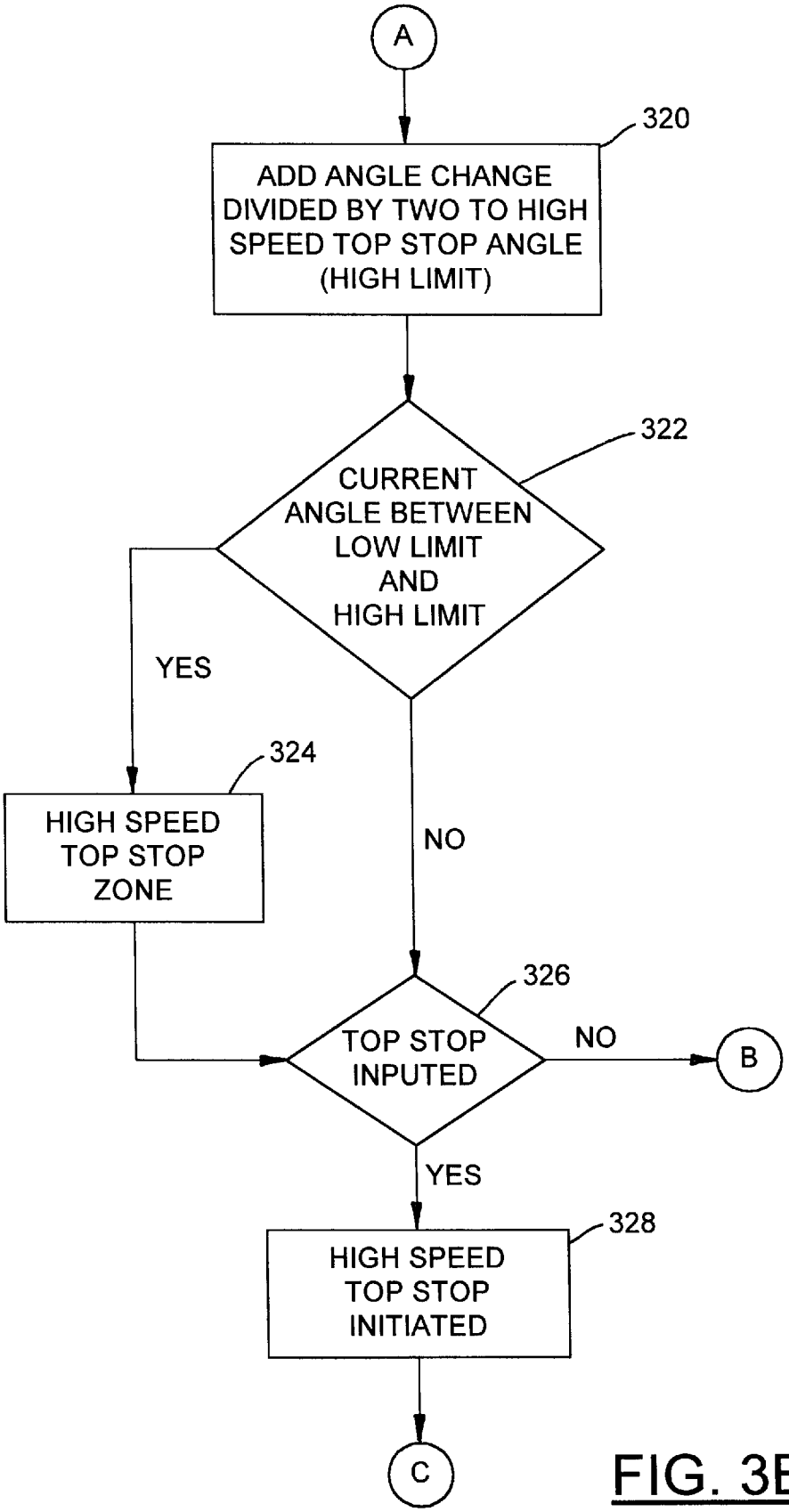
Figure 3C:
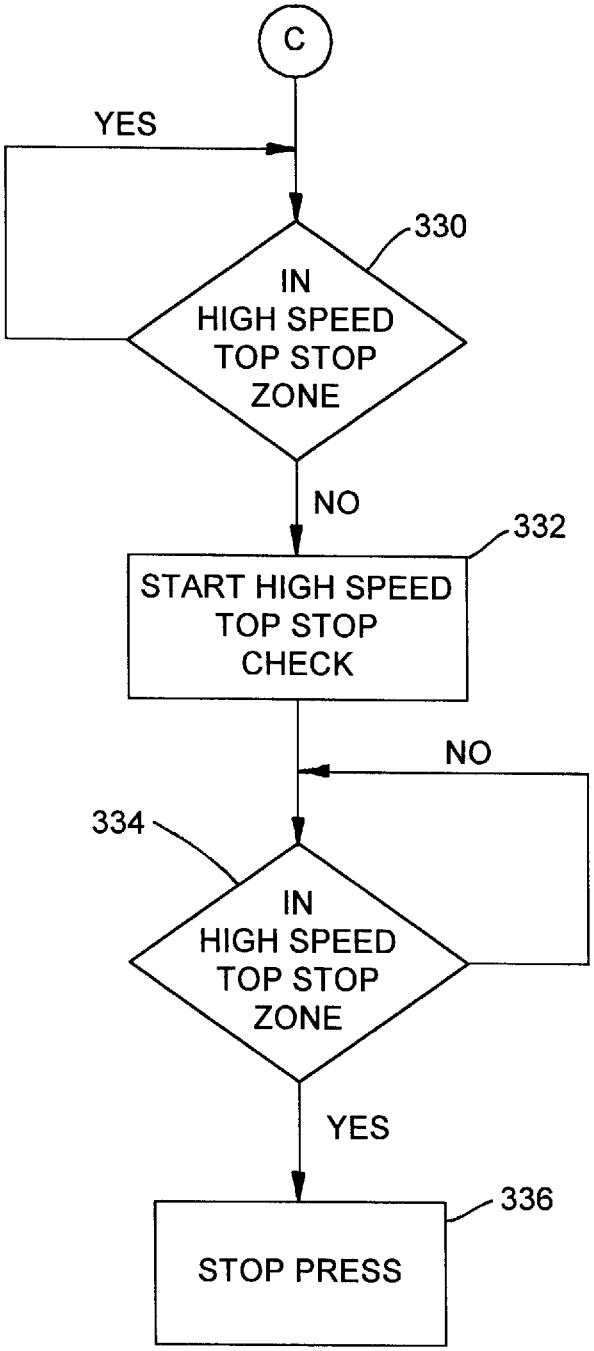

FIGS. 3A–3C illustrate a process for controlling the stopping position of the upper die 102. Like the process 200, the process 300 is implemented by each of the redundant programmable controllers 120 and 122, and is implemented using a selectable time interrupt of each respective controller. For convenience, the process 300 is again described with respect to the programmable controller 120, it being understood that the programmable controller 122 implements the same process redundantly.

As discussed above, when a top stop input is received, a stop command should be issued when the upper die 102 is at a predetermined top stop angle $\alpha_{TS}$. The top stop angle $\alpha_{TS}$ is determined such that the upper die 102 comes to a stop at the top position after braking is complete. However, the angle of the upper die 102 is not monitored continuously but rather only at periodic intervals, and thus the programmable controllers 120 and 122 are unlikely to know the precise instant at which the upper die 102 is at the top stop angle $\alpha_{TS}$ for a given stroke of the press 100.

Thus, by way of overview, the process 300 provides a way to repeatably issue the stop command when the upper die 102 is approximately at the top stop angle $\alpha_{TS}$. Specifically, the process 300 defines a high speed top stop zone which is centered about the top stop angle $\alpha_{TS}$ and which is dynamically calculated based on the speed of the upper die 102. So long as the top stop input is not initially received when the current angle of the upper die 102 is in the high speed top stop zone, the stop command is issued when the current angle of the upper die 102 is within the high speed top stop zone.

More specifically, the process 300 starts at the decision step 310 where it is determined if the stamping press 100 is in continuous mode. If instead the stamping press 100 is in manual mode, for example, then the operator controls the position of the upper die 102 manually and so there is no need to implement the process 300. The process 300 is thus terminated immediately. Assuming, however, that the press 100 is in continuous mode, the process 300 proceeds to input block 312, where the current angle $\alpha$ of the crankshaft 114 and the status of top stop inputs 128–132 are retrieved.

Next, in steps 314–320, the high speed top stop zone is defined. The high speed top stop zone is defined by the following equation:

$$\alpha_{TS} - \frac{\Delta\alpha}{2} \leqq \alpha \leqq \alpha_{TS} + \frac{\Delta\alpha}{2}$$

wherein $\alpha_{TS}$ is the top stop angle, $\alpha$ is the current angle, and $\Delta\alpha$ is the angle change, as previously defined. It may thus be noted that the size of the high speed top stop zone is approximately equal to the size of the current angle change $\Delta\alpha$, and thus is dynamically calculated based on the current speed of the upper die 102. (It may also be noted that different presses operate at different speeds, and that even the same press can operate at different speeds within the same stroke.) As a result, the high speed top stop zone is no wider than necessary, but is wide enough to ensure that the angle of the upper die 102 will be detected within the high speed top stop zone at least once per stroke.

In step 322, it is determined whether the current angle $\alpha$ of the crankshaft 114 is between the low limit and the high limit of the high speed top stop zone. If so, this means that the current angle is within the high speed top stop zone, as noted by step 324. Either way, the process 300 then proceeds to step 326.

At decision step 326, the status of the top stop inputs (which was retrieved at step 312) is checked to determined whether a top stop input was received. If not, then the next iteration of the process begins at step 312; otherwise a top stop has been requested, as noted by step 328, and the process 300 proceeds to step 330.

The purpose of steps 330–334 is to increase the repeatability of the stopping position by attempting to ensure that the stop command is issued as close to the leading edge of the high speed top stop zone as possible. This is most easily understood by way of example.

Assume that the high speed top stop angle $\alpha_{TS}$=200° and that current angle measurements for a series of three iterations of the process 300 include 185°, 195° and 205°. In this case, the top stop zone extends in the range of 195° to 205° for each of the three iterations. Notably, if a top stop input is received when the upper die reaches 193°, the next iteration of the process 300 occurs when the upper die reaches 195°, and the stop command is issued thereafter. On the other hand, if a top stop input is received when the upper die reaches 197°, the next iteration of the process 300 occurs when the upper die reaches 205°, and the stop command is issued thereafter. Thus, the top stop command could be issued at two different places within the top stop zone depending on when the top stop input is received. This introduces undesirable variability as to when the stop command is issued and as to when the upper die 102 comes to a stop. It may be noted that this problem occurs relatively frequently due to the fact that the measured speed of the press can vary by as much as twenty percent between adjacent iterations of the process 300.

The process 300 improves repeatability in this situation by causing the stop command to be issued at the first iteration of the process 300 which occurs within the top stop zone. Thus, in the example above, if the top stop input is received when the upper die reaches 193° (i.e., before reaching the top stop zone), then decision block 330 is answered "No" and the process 300 proceeds to steps 332–334. On the other hand, if the top stop input is received when the upper die 102 reaches 197° (i.e., after entering but before leaving the top stop zone), then decision block 330 is answered "Yes" and the process remains at the decision block 330 until the upper die 102 leaves the top stop zone. (Note that it is possible for the upper die 102 to be within the top stop zone for even more than two iterations.)

Once there has been one iteration of the decision block 330 which occurred when the upper die 102 was not in the top stop zone, then the process 300 proceeds to steps 332–334. (Note that, in both steps 334 and 330, the current angle position is remeasured and a new top stop zone is recalculated in the manner described in steps 312–322.) Then, when the upper die 102 enters/re-enters the top stop zone, a stop command is issued at step 336.

Advantageously, therefore, the process 300 has improved repeatability characteristics as compared to prior art methods of stopping a press. The high speed top stop zone is dynamically determined based on the angle change of the upper die 102. Thus, generally speaking, the high speed top stop zone is no wider than necessary, but is wide enough to ensure that the angle of the upper die will be detected within the high speed top stop zone at least once per stroke. This is desirable because the amount of variance in the stopping angle is directly related to the size of the top stop zone.

Furthermore, in cases where the top stop zone is unavoidably wider than necessary (for example, due to changes in the speed of the press), the process 300 improves repeatability characteristics by ensuring that the stopping command is issued as close to the leading edge of the high speed top stop zone as possible. This increases the repeatability of the stopping angle by limiting the range of angles at which a stop command may be issued when the top stop zone is wider than necessary.

Finally, by using a selectable time interrupt, the process 300 enables the repeatability of the stopping position to be varied and improved. By shortening the duration of the STI interval, the angle change per STI interval decreases and thus the width of the top stop zone decreases. As a result, the repeatability of the final stopping angle increases.

Note that while the top stop zone is dynamically determined based on the two most recent angle positions of the upper die 102, there are other ways in which the top stop zone could be dynamically determined. For example, a running average of the angle change could be maintained, and the running average could be used to determine the top stop zone.

Many other changes and modifications may be made to the present invention without departing from the spirit thereof. For example, the present invention could be used in conjunction with other types of mechanical presses besides a stamping press. Further, the present invention could be used for measuring the brake time and/or for controlling the stopping position in non-mechanical presses, e.g., such as a hydraulic press. The scope of these and other changes will become apparent from the appended claims.

We claim:

1. A press comprising:

a movable die;

a drive mechanism, said drive mechanism being coupled to said die and driving movement of said die;

a measurement device, said measurement device being coupled to said die and measuring said movement of said die; and a programmable controller, said programmable controller being electrically connected to said drive mechanism and to said measurement device, said programmable controller having the ability to control the starting and stopping of said movement of said die during normal operation of said press, said programmable controller sending a stop command to stop said movement of said die, and said programmable controller measuring a brake time of said die after said stop command is issued, said programmable controller further including a microprocessor, and a program, said program being executable by said microprocessor to measure said brake time of said die after said stop command has been issued, including being executable to calculate a brake time value indicative of said brake time, and said brake time being measured based on inputs from said measurement device.

2. The press according to claim 1, wherein said program is an interrupt routine which is executed at regular time intervals.

3. The press according to claim 1, wherein said drive mechanism is an electric motor, and further comprising a clutch/brake mechanism having a clutch and a brake;

a flywheel, said flywheel being coupled to said motor and being driven by said motor;

a crankshaft, said crankshaft being selectively coupled to said flywheel by said clutch, and said crankshaft being coupled to said die and driving said movement of said die; and wherein said motor is coupled selectively and indirectly to said die by way of said flywheel and said crankshaft; and wherein said measurement device is a resolver, said resolver being coupled to said crankshaft.

4. A method of measuring a brake time of a die of a press, the method comprising:

A. issuing a stop command; and

B. measuring said brake time of said die, including the steps of 1. initiating a brake time counter,
2. determining whether said die is still moving,
3. incrementing said brake time counter, and
4. repeating said determining and incrementing steps at least until said die stops moving, and
5. calculating a brake time value indicative of said brake time;

wherein both said issuing step and said measuring step are performed by a programmable controller that has the ability to control the starting and stopping of movement of said die during normal operation of said press.

5. The method according to claim 4, further comprising displaying said brake time value.

6. The method according to claim 4, further comprising determining compliance with a predetermined safety standard that pertains to said brake time, said determining step being performed using said brake time value.

7. A method of measuring a brake time of a die of a press, the method comprising:

issuing a stop command; and measuring said brake time of said die, including the steps of initiating a brake time counter, determining whether said die is still moving, incrementing said brake time counter, and repeating said determining and incrementing steps at least until said die stops moving;

wherein both said issuing step and said measuring step are performed by a programmable controller;

wherein said measuring step is performed by an interrupt routine of said programmable controller;

wherein said issuing and measuring steps are each performed at least twice to produce first and second brake time measurements having different precisions;

and wherein, to achieve said different precisions, said interrupt routine is executed at regular time intervals of a first equal duration during the first performance of said measuring step, and then is executed at regular time intervals of a second equal duration during the second performance of said measuring step, said first equal duration being different than said second equal duration.

8. The method according to claim 4, wherein said step of determining whether said die is still moving further comprises the step of determining whether a measured angle change of said die is invalid by determining whether said angle change is greater than a predetermined value.

9. The method according to claim 4, wherein the position of said die is measured with a resolver mounted on a crankshaft which drives said die, and wherein said step of determining whether said die is still moving further comprises determining whether the resolver has incurred a zero crossing.

10. A method of measuring a brake time of a die of a press, the method comprising:

A. issuing a stop command; and

B. measuring said brake time of said die, including the steps of 1. initiating a brake time counter,
2. determining whether said die is still moving, including the step of filtering mechanical vibrations of said press, said filtering step including steps of
   a. initiating a filter counter,
   b. determining an angle change of said die,
      i. and, if said angle change is positive, then incrementing said filter counter,
      ii. and, if said angle change is not positive, then resetting said filter counter; and
   c. determining whether said filter counter has reached a predetermined value,
3. incrementing said brake time counter,
4. repeating said determining and incrementing steps at least until said die stops moving, and
5. subtracting the value of said filter counter from the value of said brake time counter;

wherein both said issuing step and said measuring step are performed by a programmable controller.

11. The method according to claim 4, further comprising calculating a change in position of said die; and displaying said change in said position of said die;

wherein said calculating and displaying steps are performed by an interrupt routine of said programmable controller.

12. The method according to claim 4, wherein said brake time is measured substantially every time said die brakes.

13. A method of stopping a moving die of a press, comprising:

A. determining a current angle of said die;

B. dynamically determining a stop zone, said stop zone including a stop angle, said stop angle being separated from a desired stop position by a braking angle, said braking angle being an angle change of said die as said die brakes to a stop, and said dynamically determining step including 1. determining the speed of said die, and
2. determining the size of said stop zone as a function of said speed of said die;

C. determining whether said current angle is within said stop zone; and

D. sending a stop command to stop said die when said current angle is within said stop zone.

14. The method according to claim 13, wherein said speed of said die is determined based on said current angle of said die and on a previous angle of said die.

15. The method according to claim 13, wherein said stop command is issued responsive to a stop input, and further comprising delaying said stop command if said stop input is received after said die is already in said stop zone.

16. The method according to claim 13, wherein a selectable time interrupt causes an interrupt routine to be executed at regular intervals, and wherein said interrupt routine performs said steps (A)–(D).

17. A method of stopping a moving upper die of a mechanical press at a top position, comprising:

A. repeatedly determining a current angle of said upper die;

B. dynamically determining a top stop zone, said top stop zone including a top stop angle, said top stop angle being separated from said top position by a braking angle, said braking angle being the angle change of said upper die as said upper die brakes to a stop, said dynamically determining step including the steps of 1. comparing said current angle to a previous angle to determine a current angle change, and
2. determining said top stop zone as a function of said current angle change;

C. determining, for a first time, whether said current angle is within said top stop zone and, if said current angle is within said top stop zone, then repeating said determining step (C) until said current angle is not within said top stop zone; and then D. determining, for a second time, whether said current angle is within said top stop zone and, if said current angle is not within said top stop zone, then repeating said determining step (D) until said current angle is within said top stop zone; and then E. sending a stop command to stop said die when said current angle is within said stop zone;

wherein a selectable time interrupt causes an interrupt routine to be executed at regular intervals, and wherein said interrupt routine performs said steps (A)–(E).

* * * * *